US007973476B2

(12) United States Patent
Koger et al.

(10) Patent No.: US 7,973,476 B2
(45) Date of Patent: Jul. 5, 2011

(54) HIGH-PRESSURE MERCURY DISCHARGE LAMP

(75) Inventors: Rainer Koger, Berlin (DE); Markus Kolodziejczyk, Berlin (DE); Wolfgang Spielmann, Ehrwald (AT)

(73) Assignee: OSRAM Gesellschaft mit beschränkter Haftung, München (DE)

( * ) Notice: Subject to any disclaimer, the term of this patent is extended or adjusted under 35 U.S.C. 154(b) by 207 days.

(21) Appl. No.: 12/448,399

(22) PCT Filed: Dec. 17, 2007

(86) PCT No.: PCT/EP2007/064030

§ 371 (c)(1),
(2), (4) Date: Jun. 18, 2009

(87) PCT Pub. No.: WO2008/077832

PCT Pub. Date: Jul. 3, 2008

(65) Prior Publication Data

US 2009/0289550 A1 Nov. 26, 2009

(30) Foreign Application Priority Data

Dec. 22, 2006 (DE) ..... 10 2006 061 375

(51) Int. Cl.
*H01J 16/20* (2006.01)

(52) U.S. Cl. ..... 313/571; 313/632

(58) Field of Classification Search ..... None
See application file for complete search history.

(56) References Cited

U.S. PATENT DOCUMENTS

| | | | | |
|---|---|---|---|---|
| 2,965,790 | A * | 12/1960 | Ittig et al. | 313/570 |
| 5,357,167 | A * | 10/1994 | Mathews et al. | 313/632 |
| 6,369,508 | B1 | 4/2002 | Lochschmidt | |
| 6,844,678 | B2 | 1/2005 | Okanuma et al. | |
| 6,936,956 | B2 | 8/2005 | Ikeuchi et al. | |
| 7,206,420 | B2 | 4/2007 | Bizjak | |
| 7,279,839 | B2 * | 10/2007 | Menzel et al. | 313/633 |
| 2002/0079842 | A1 | 6/2002 | Ehrlichmann et al. | |
| 2003/0168981 | A1 * | 9/2003 | Kanzaki | 313/631 |
| 2004/0169476 | A1 | 9/2004 | Ehrlichmann et al. | |
| 2007/0148031 | A1 | 6/2007 | Spielmann et al. | |
| 2007/0172378 | A1 | 7/2007 | Shibuya et al. | |

FOREIGN PATENT DOCUMENTS

| | | | |
|---|---|---|---|
| DE | 30 36 746 | A1 | 9/1980 |
| DE | 30 36 746 | C2 | 9/1980 |
| DE | 197 38 574 | A1 | 9/1997 |
| DE | 198 52 703 | A1 | 11/1998 |
| DE | 199 51 445 | C1 | 7/2001 |
| DE | 101 32 797 | A1 | 5/2002 |
| EP | 1 193 733 | A2 | 4/2002 |
| EP | 1 193 733 | B1 | 4/2002 |
| EP | 1 357 579 | A2 | 10/2003 |
| EP | 1 357 579 | A3 | 10/2003 |
| EP | 1 801 247 | A1 | 6/2007 |

(Continued)

*Primary Examiner* — Ashok Patel
(74) *Attorney, Agent, or Firm* — Holtz, Holtz, Goodman & Chick, PC

(57) ABSTRACT

The invention relates to a high-pressure mercury discharge lamp for DC operation at a nominal wattage of more than 1.5 kW. Said high-pressure mercury discharge lamp comprises an anode, at least some areas of which are made of a material containing at least some tungsten, said material having a grain number of more than 200 grains per $mm^2$ and a density of more than 19.05 $g/cm^3$.

19 Claims, 3 Drawing Sheets

FOREIGN PATENT DOCUMENTS

| | | | |
|---|---|---|---|
| EP | 1 801 247 | B1 | 6/2007 |
| WO | WO 03/075311 | A1 | 9/2003 |
| WO | WO 03/107388 | A2 | 12/2003 |
| WO | WO 03/107388 | A3 | 12/2003 |
| WO | WO 2005/073418 | A1 | 8/2005 |

* cited by examiner

HIGH-PRESSURE MERCURY DISCHARGE LAMP

This application is a U.S. National Phase Application under 35 USC 371 of International Application PCT/EP2007/064030, filed Dec. 17, 2007, which is incorporated herein in its entirety by this reference.

TECHNICAL FIELD

The invention relates to a high pressure mercury discharge lamp comprising an anode that is formed at least in some areas from a material that has at least a proportion of tungsten.

PRIOR ART

In high pressure mercury discharge lamps, the anode is heated up as a consequence of the electron bombardment. This causes an evaporation of anode material that is deposited on the inner side of a discharge vessel of the discharge lamp. The coating thus produced on this inner side, which can be perceived as bulb turbidity or bulb blackening, attenuates the radiation produced in the arc, and the useful radiant flux from the discharge lamp is thereby reduced. This effect is augmented in the course of the lifetime of the discharge lamp. With increasing operating time of the discharge lamp, a decrease in the radiant flux occurs owing to the evaporation of anode material.

Apart from the evaporation of anode material, there are further phenomena in the case of high pressure discharge lamps that cause reduction in the useful radiation for the user. Mention may be made in this respect of cathode burn-back and the broadening of the cathode plateau. In mercury discharge lamps that have a mercury fill quantity of approximately 1 to 8 mg/cm$^3$, the evaporation of anode material is a decisive degradation mechanism, and is therefore heavily responsible for the lifetime behavior of the lamp.

The evaporation of anode material is intensified when the mercury discharge lamp has high inert gas fill pressure that corresponds, in particular, to a cold fill pressure of higher than 3 bar. The high inert gas fill, use typically being made as fill gases of argon, krypton or mixtures thereof with one another and/or with xenon, in these lamps ensures a reduction in the width of the arc. During use in an optical system, this augments the radiation that can be used by the optical system, and the lamp has a higher radiant intensity in the system (called high intensity lamp). The high loading of the anode that accompanies high inert gas pressures can also cause the anode plateau to tear, and this further intensifies the evaporation of anode material.

The high pressure mercury discharge lamps are usually operated with direct current and constant power. In a few applications, however, it can be advantageous to modulate the power cyclically. However, this can result in an intensified evaporation of anode material, with the decline in radiation becoming excessively large.

The reduction in the evaporation of anode material occurs in practice owing to a lowering of the anode temperature, which is achieved by augmenting the energy emitted by the anode. Two techniques come into use here, the anode surface or the anode size being augmented in the first of these. It is the increase in the anode diameter that is particularly advantageous here. The lengthening of the anode is attended by fewer advantages by comparison therewith. In known lamps, increasing lamp power is also accompanied as a rule by an augmentation of the anode diameter. A second technique relates to the fact that the anode is coated and/or structured, the aim thereby being to achieve an increase in emissivity. Coarse tungsten or dendritic rhenium, for example, are used as coating materials.

However, in mercury discharge lamps with a high inert gas fill pressure, starting from a specific value of the cold fill pressure that is dependent on the type of inert gas and the light geometry, the problem can arise that even when use is made of both the above-named techniques the evaporation of anode material is to be reduced not only to below a value that is acceptable in practice for requirements. In this case, the inert gas fill pressure must be lowered. The effect of constricting the arc is thereby reduced, however, and this becomes noticeable in a reduced intensity when the lamps are used in an optical system. Alternatively, the electric power or the lamp current can also be lowered, but this results in a reduction in the radiant intensity of the lamp.

Known from the prior art are discharge lamps in the case of which the anode is formed from tungsten with an extra element. The extra element can, for example, also be potassium and has a proportion of between 15 ppm and 300 ppm. Such a configuration of an anode is known from DE 30 36 746 C2.

Moreover, DE 198 52 703 A1 discloses a discharge lamp comprising an anode that is formed from tungsten or from an alloy that can, for example, be doped with potassium. The doping can be less than 100 ppm, for example.

Moreover, DE 197 38 574 A1 discloses a discharge lamp with an anode that has a cylindrical basic body. The cylindrical basic body comprises a conically tapering tip that is produced largely by radial deformation. Grain size and intensity at the tip can change by comparison with the shaft typically by a factor of 2 and more.

SUMMARY OF THE INVENTION

It is the object of the present invention to provide a high pressure mercury discharge lamp in the case of which a reduction in the evaporation of the electrode material can be achieved during operation.

This object is achieved by a high pressure mercury discharge lamp that has the features according to patent claim 1.

In the high pressure mercury discharge lamp according to the invention, the anode is formed at least in some regions from a material that has at least a proportion of tungsten. This material or this material region of the anode has a grain number of greater than 200 grains per mm$^2$ (grain number per square millimeter) and a density of higher than 19.05 g/cm$^3$. It is thereby possible to achieve a substantial reduction in the evaporation of the electrode material. Specifically, it has emerged that the above-named improvement in case of highly loaded high pressure mercury discharge lamps, in particular with nominal powers above 1.5 kW, with an anode diameter of between 25 mm and 70 mm, and with mercury fill quantities of between 0.5 mg/cm$^3$ and 7 mg/cm$^3$ as well as high inert gas cold fill pressures, in particular higher than 0.8 bar, can be attained only when the number of grains of the anode is greater than 200 grains per mm$^2$, and the density of the anode is higher than 19.05 g/cm$^3$. If only one of the two parameters lies in the given range and the other lies outside, only a slight improvement is attained, however.

The anode diameter is the maximum diameter of the anode in this case. If, as usual, the anode has a cylindrical region and a conical one adjacent thereto, the diameter of the cylindrical region is the anode diameter.

According to the current state of knowledge, it is assumed that the arc induces thermal stresses that cause the formation of protuberances in the region of the anode plateau in the case of DC lamps. Consequently, the arc can set at this protuberance, resulting in local overheating. This can go so far that the melting point of tungsten (3400° C.) is locally exceeded. This then leads to excessive evaporation of tungsten and to blackening of the lamp bulb and, consequently, to a drastic reduction in the luminous flux.

The material preferably has a density of higher than or equal to 19.15 g/cm$^3$.

The material preferably has a grain number of greater than or equal to 350 grains per mm$^2$. The evaporation behavior can be once again substantially reduced by this configuration.

The grain number of the anode is defined here as mean grain number in accordance with ASTM E 112, specifically before the lamp is taken into operation. Specifically, instances of structural coarsening can occur during operation of the lamp such that the anode has locally coarser grains in the course of use.

In order to reduce grain coarsening, the material is preferably doped with potassium. The proportion of potassium is at most 100 μg/g, preferably less than 50 ppm, in particular between 8 ppm and 45 ppm. In particular the potassium proportion lies between 10 ppm and 40 ppm.

The anode is preferably of cylindrical design, at least in some areas. The anode is preferably conically designed at its front side. However, the anode can also exhibit other geometric shapings.

The cylindrical area of the anode preferably comprises a diameter of greater than 28 mm, in particular greater than or equal to 30 mm. It is particularly preferred when the diameter of this cylindrical area is greater than or equal to 34 mm. It is thereby possible to achieve a substantial reduction in the evaporation of the material during operation. Because of the functionality, material evaporation is relatively problematic precisely in the case of anodes, and can be substantially reduced by the inventive configuration.

The high pressure mercury discharge lamp according to the invention has a mercury fill quantity of between 0.5 mg/cm$^3$ and 7 mg/cm$^3$. In particular, a reduction in the evaporation occurs when the mercury fill quantity is between 1 mg/cm$^3$ and 3 mg/cm$^3$. The high pressure mercury discharge lamp preferably has an inert gas cold fill pressure of higher than 3.5 bar, in particular higher than or equal to 4 bar, in the case of a design in which the lamp is operated with a constant power. When the lamp is operated with power modulation, the inert gas cold fill pressure is typically higher than 0.8 bar, in particular higher than 1.5 bar. In such a high pressure mercury discharge lamp with such inert gas cold fill pressures and an inventively formed anode, a particularly effective reduction in the evaporation of the electrode material is ensured.

Xenon, argon or krypton, or mixtures of these inert gases, are preferred as types of inert gas.

Substantial reduction in evaporation of the electrode material, in particular of the anode material, may already be seen at a nominal lamp power of more than 1.5 kW, for example 4 kW, but occurs particularly clearly for nominal lamp powers of approximately 5 kW and higher. The reduction in the evaporation of the electrode material will occur in independently of the nature of the surface of the electrode, in particular of the anode, and thus independently of the structuring and/or coating thereof.

The final fabrication and shaping of the electrode then comprises already known procedures such as hammering, grinding, milling, washing and cleaning and annealing. However, it can be provided to forge the plateaus of the electrodes axially.

The invention can render it possible for high pressure mercury discharge lamps in the case of which the anodes, in particular, are constructed at least in some areas from the inventive material to have a substantially smaller reduction in the radiant flux in the course of the service life than similar lamps where the anode consists of a conventional tungsten material. This pertains principally to lamps with a high inert gas fill pressure, or to lamps in which the electric power is moderated cyclically during operation.

A further advantage of the invention resides in the fact that the method of production for the electrodes need not be changed by comparison with known electrodes with tungsten material.

BRIEF DESCRIPTION OF THE DRAWINGS

The invention is explained in more detail below with the aid of schematics, in which.

PREFERRED DESIGN OF THE INVENTION

Figure 1:
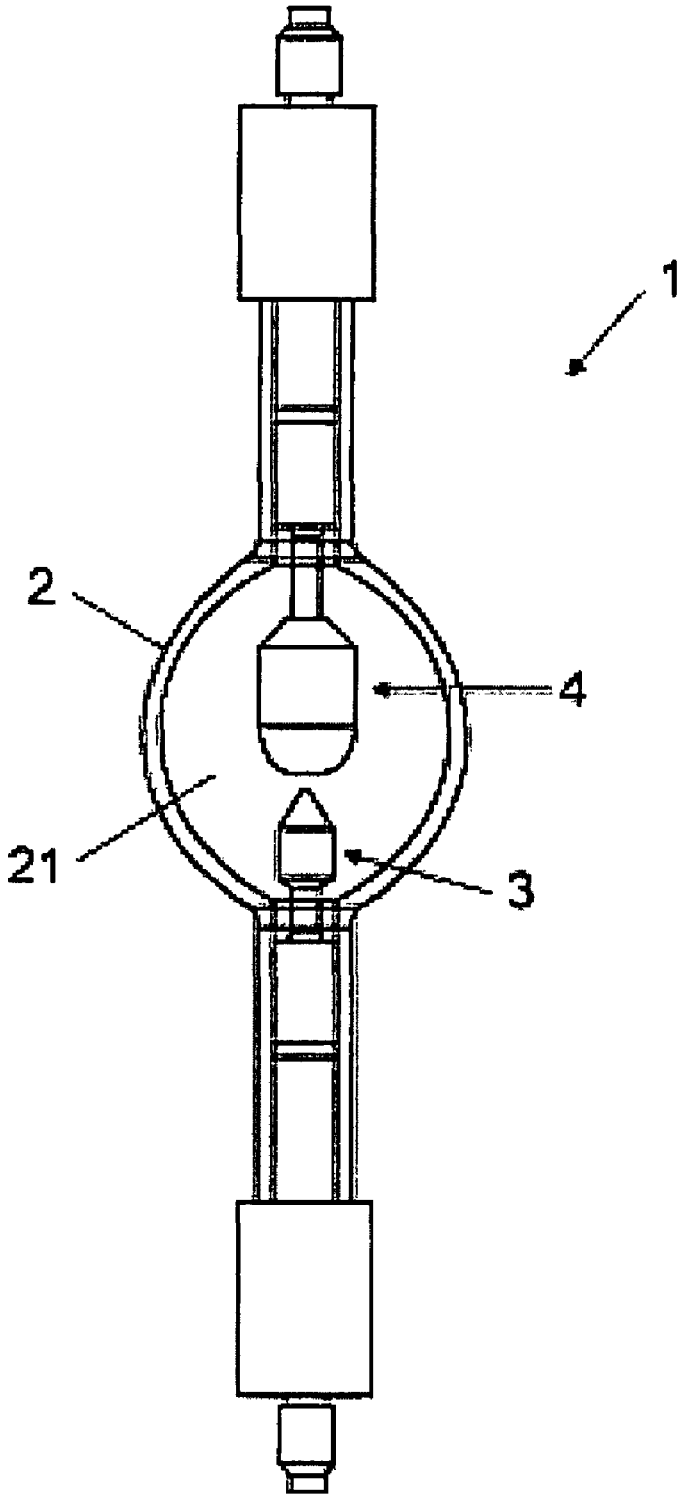
FIG. 1 shows an inventive discharge lamp in accordance with an exemplary embodiment.

Identical or functionally identical elements are provided in the figures with the same reference numerals.

FIG. 1 is a schematic of a discharge lamp 1 designed as high-pressure mercury discharge lamp. Said discharge lamp comprises in a known way a discharge vessel 2 in whose interior 21 a cathode 3 and an anode 4 extend. In accordance with the illustrations in FIG. 2 and FIG. 3, the anode 4 is of substantially cylindrical design.

Figure 2:
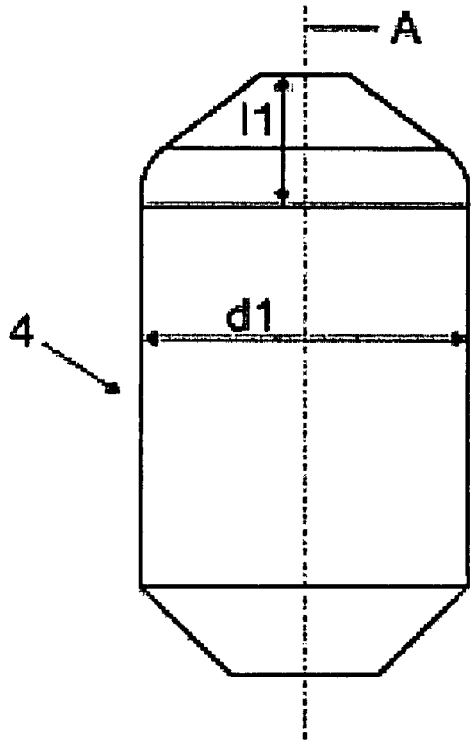
FIG. 2 shows an inventive anode in accordance with a first exemplary embodiment.

In FIG. 2, the anode has a diameter d1 that is approximately 35 mm. The longitudinal extent in the direction of the axis A is approximately 65 mm. The anode 4' is also designed in a corresponding way, and the diameter d2 there is also approximately 35 mm. In a similar way, this configuration of the anode 4' likewise extends over a length of approximately 65 mm in the direction of the axis B.

In the first design, shown in FIG. 2, of the anode 4, the latter is of tapering design or conically shaped on its front side and thus along the side facing the cathode 3. The conical portion extends over a length 11. In the second design of the anode 4' in FIG. 3, the front side is also designed there as a conical configuration that extends there over a length 12 that is smaller than the length 11.

Figure 3:
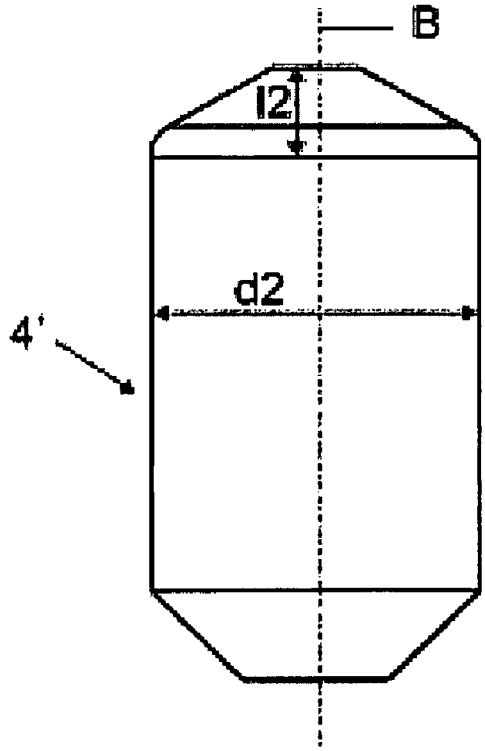
FIG. 3 shows an inventive anode in accordance with a second exemplary embodiment.

Both shapings of the anodes 4 and 4', respectively, shown in FIG. 2 and FIG. 3 can be arranged in the discharge lamp 1 in accordance with FIG. 1.

In the exemplary embodiment, the anode 4 arranged in the discharge lamp 1 is formed from a tungsten material that has a grain number of greater than 350 grains per mm$^2$. Moreover, the material of the anode 4 is formed with a density of higher than or equal to 19.15 g/cm$^3$. Furthermore, the material of the anode 4 is doped with potassium, the proportion of potassium being between 10 ppm and 40 ppm.

The discharge lamp is operated with direct current and has a nominal lamp power of higher than or equal to 5 kW. The mercury fill quantity is between 0.5 mg/cm$^3$ and 5 mg/cm$^3$. It is particularly advantageous for this mercury fill quantity to be between 1 mg/cm$^3$ and 3 mg/cm$^3$. The inert gas cold fill pressure in the interior 21 is 4 bar or more in the case of the lamp being operated with constant power 4. In the case of the lamp being operated with power modulation, the inert gas cold fill pressure is higher than or equal to 1.5 bar. In the case of a modulation of the lamp power, the latter is performed with amplitudes of up to 15% and frequencies of between 0.5 Hz and 5 Hz.

In the exemplary embodiment, the anode 4 is formed homogeneously from the doped tungsten material with said density and said grain number. However, it can also be provided that only a sub-region of the anode 4 is formed from such a material. Thus, it can be provided that the anode 4 is composed of a number of partial elements. It is particularly preferred when at least the region facing the cathode 3, thus the conical region or a sub-region of this conical region, is formed from a tungsten material that has an above-named grain number and a corresponding density and/or a corresponding doping with potassium. Likewise, it can be provided that only a pin-like sub-region of the anode 4 or 4' formed in a centered fashion and in an axial direction A or B is formed with such a material.

Figure 4:
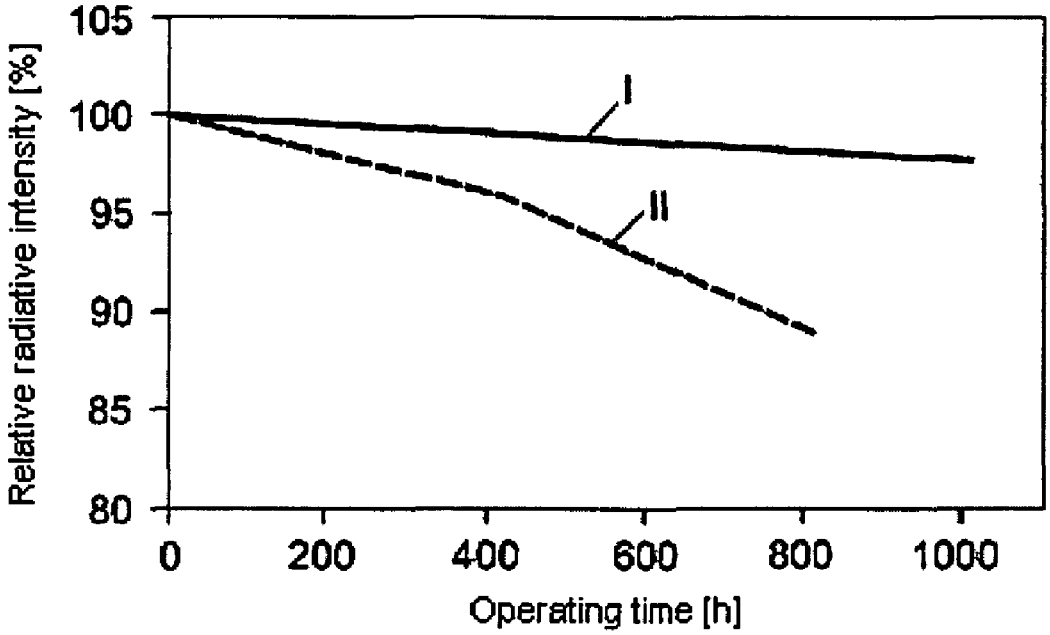
FIG. 4 shows the relative radiant intensity of a lamp as a function of the operating time of an inventive discharge lamp with first lamp parameter values.

FIG. 4 shows a diagram in which the relative radiant intensity of the discharge lamp 1 is illustrated as a function of the operating time. The discharge lamp 1 in this case has parameter settings that have an inert gas cold fill pressure of 4 bar and include krypton as inert gas. Moreover, the discharge lamp 1 is operated with a constant electric power of 5.5 kW. In this diagram, the continuous characteristic I shows the radiant flux of the lamp, which is designed with an inventive anode. By comparison therewith, the characteristic II shows a discharge lamp 1 with a conventional anode.

Figure 5:
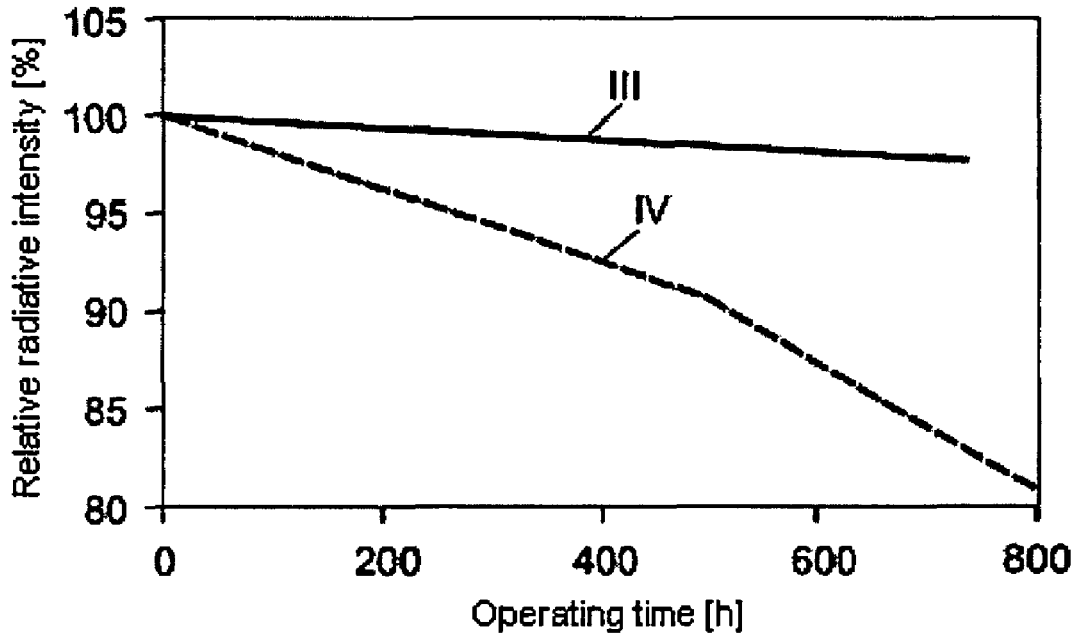
FIG. 5 shows the relative radiant intensity of a lamp as a function of the operating time of an inventive discharge lamp with second lamp parameter values.

FIG. 5 shows a further diagram in which the relative radiant intensity of the discharge lamp 1 is illustrated as a function of the operating time. In this diagram, the lamp parameters have been changed to the effect that the inert gas cold fill pressure is 1.9 bar and a xenon/krypton mixture is used as inert gas fill. The operation of the discharge lamp 1 is performed with a cyclically modulated electric power of between 4.5 kW and 5 kW. In the diagram in accordance with FIG. 5, the characteristic III illustrates the course of the radiant flux of the discharge lamp I with an inventive anode, the characteristic IV shown with dashes showing a discharge lamp with a conventional anode. It is to be seen in both diagrams that it is possible by using the inventive anode to attain a substantially higher radiant intensity over the course of the service life. A drastic decrease with rising operating time such is the case through the characteristics II and IV for known discharge lamps does not occur in the case of the inventive discharge lamps.

The invention claimed is:

1. A high pressure mercury discharge lamp that is provided for DC operation with a nominal power of higher than 1.5 kW, comprising a discharge vessel, an anode and a cathode that are arranged in the discharge vessel, the diameter of the anode being between 25 mm and 70 mm, and at least the anode being formed, at least in some areas, from a material that has at least a proportion of tungsten and a fill that is located inside the discharge vessel and contains mercury with a fill quantity of between 0.5 mg/cm$^3$ and 7 mg/cm$^3$, as well as at least one inert gas with a cold fill pressure of higher than 0.8 bar, characterized in that the material of the anode has a grain number of greater than 200 grains per mm$^2$ and a density of higher than 19.05 g/cm$^3$.

2. The discharge lamp as claimed in claim 1, characterized in that the material has a grain number of greater than or equal to 350 grains per mm$^2$.

3. The discharge lamp as claimed in claim 1 or 2, characterized in that the material has a density of higher than or equal to 19.15 g/cm$^3$.

4. The discharge lamp as claimed in claim 3, characterized in that the material is doped with potassium, the proportion being at most 100 μg/g.

5. The discharge lamp as claimed in claim 4, characterized in that the proportion of potassium is no more than 50 ppm.

6. The discharge lamp as claimed in claim 1, characterized in that the anode is of cylindrical design, at least in some areas.

7. The discharge lamp as claimed in claim 6, characterized in that the cylindrical area has a diameter of greater than 28 mm.

8. The discharge lamp as claimed in claim 6, characterized in that the cylindrical area has a diameter greater than or equal to 30 mm.

9. The discharge lamp as claimed in claim 6, characterized in that the cylindrical area has a diameter greater than or equal to 34 mm.

10. The discharge lamp as claimed in claim 1 characterized in that the inert gas cold fill pressure is higher than or equal to 0.8 bar, when the lamp is being operated with a modulated electric power.

11. The discharge lamp as claimed in claim 1, characterized in that the nominal power of the lamp is higher than 4 kW.

12. The discharge lamp as claimed in claim 1, characterized in that the proportion of potassium is no more than 50 ppm.

13. The discharge lamp as claimed in claim 1, characterized in that the proportion of potassium is between 8 ppm and 45 ppm.

14. The discharge lamp as claimed in claim 1, characterized in that the proportion of potassium is between 10 ppm and 40 ppm.

15. The discharge lamp as claimed in claim 1, characterized in that the mercury fill quantity is between 1 mg/cm$^3$ and 3 mg/cm$^3$.

16. The discharge lamp as claimed in claim 1, characterized in that the inert gas cold fill pressure is higher than or equal to 3.5 bar, when the lamp is being operated with a constant electric power.

17. The discharge lamp as claimed in claim 1, characterized in that the inert gas cold fill pressure is higher than or equal to 4 bar, when the lamp is being operated with a constant electric power.

18. The discharge lamp as claimed in claim 1, characterized in that the inert gas cold fill pressure is higher than or equal to 1.5 bar, when the lamp is being operated with a modulated electric power.

19. The discharge lamp as claimed in claim 1, characterized in that the nominal power of the lamp is higher than or equal to 5 kW.

* * * * *